US010753641B2

(12) United States Patent
Rowland

(10) Patent No.: US 10,753,641 B2
(45) Date of Patent: Aug. 25, 2020

(54) DRAIN PAN WITH INTEGRATED RISER

(71) Applicant: J.F.R. Enterprises, Inc., Johns Creek, GA (US)

(72) Inventor: Jay F Rowland, Johns Creek, GA (US)

(73) Assignee: J.F.R. Enterprises, Inc.., Johns Creek, GA (US)

( * ) Notice: Subject to any disclaimer, the term of this patent is extended or adjusted under 35 U.S.C. 154(b) by 581 days.

(21) Appl. No.: 15/418,631

(22) Filed: Jan. 27, 2017

(65) Prior Publication Data

US 2017/0138631 A1 May 18, 2017

Related U.S. Application Data

(63) Continuation of application No. 14/715,734, filed on May 19, 2015, now Pat. No. 9,557,094, which is a continuation of application No. 11/320,992, filed on Dec. 29, 2005, now Pat. No. 9,074,812.

(60) Provisional application No. 60/640,332, filed on Dec. 30, 2004.

(51) Int. Cl.

| | |
|---|---|
| ***F24F 13/22*** | (2006.01) |
| ***B65D 1/34*** | (2006.01) |
| ***B65D 1/40*** | (2006.01) |
| ***B65D 21/02*** | (2006.01) |
| ***F25D 21/14*** | (2006.01) |

(52) U.S. Cl.

CPC ..... *F24F 13/222* (2013.01); *B65D 1/34* (2013.01); *B65D 1/40* (2013.01); *B65D 21/0209* (2013.01); *F25D 21/14* (2013.01); *F25D 2500/02* (2013.01)

(58) Field of Classification Search

CPC ..... F24F 13/222; F24F 2140/30; F24F 13/22; F25D 21/14; F25D 2500/02; F25D 2321/145; B65D 21/0209; B65D 1/34; B65D 1/40; Y10T 137/5762; F24H 9/165

See application file for complete search history.

(56) References Cited

U.S. PATENT DOCUMENTS

| | | | |
|---|---|---|---|
| D32,575 | S | 4/1900 | Stevenson |
| 1,487,065 | A | 3/1924 | Irons |
| 1,584,175 | A | 5/1926 | Irons |
| 1,915,849 | A | 6/1933 | Grimmel et al. |
| 2,544,743 | A | 3/1951 | Vrabcak |

(Continued)

FOREIGN PATENT DOCUMENTS

| | | | |
|---|---|---|---|
| AU | 2006100199 | A4 | 4/2006 |
| DE | 2650288 | A1 | 5/1978 |

(Continued)

OTHER PUBLICATIONS

Non-final Office Action and Notice of References cited for U.S. Appl. No. 11/833,298 dated Dec. 23, 2009.

(Continued)

*Primary Examiner* — Frantz F Jules
*Assistant Examiner* — Martha Tadesse
(74) *Attorney, Agent, or Firm* — Louis J. Hoffman

(57) ABSTRACT

A drain pan for an air handling unit including a base, a lip attached to the base wherein the lip extends substantially vertically from the base, and a riser affixed to the base wherein the riser extends substantially vertically from the base to support the air handling unit. The drain pan may further include a riser that is preformed with the base to form a unibody drain pan.

22 Claims, 4 Drawing Sheets

(56) References Cited

U.S. PATENT DOCUMENTS 2,934,003 A 4/1960 Ladymon
2,951,674 A * 9/1960 Rice ..... F16F 1/3732 267/141.4
3,318,107 A 5/1967 Riley
3,367,132 A 2/1968 Elliott
3,480,178 A 11/1969 Morgan
3,724,233 A 4/1973 Pugh et al.
3,788,581 A 1/1974 Rutzick
3,790,115 A 2/1974 Fox et al.
3,848,546 A 11/1974 Lawlor
3,888,090 A 6/1975 Meyer
4,025,063 A * 5/1977 Willison ..... B60G 11/22 267/153
4,050,659 A 9/1977 McCannon et al.
4,243,197 A 1/1981 Wright
D262,104 S 12/1981 Simpson
D271,328 S 11/1983 Lanier et al.
4,480,748 A 11/1984 Wind
4,484,661 A 11/1984 Evenson
4,604,874 A 8/1986 Seeley
4,644,753 A 2/1987 Burke
4,653,651 A 3/1987 Flum
4,687,604 A 8/1987 Goettl
4,733,790 A 3/1988 Stein
4,783,971 A 11/1988 Alba
4,814,752 A 3/1989 Lehman
4,835,984 A 6/1989 Vyavaharkar et al.
4,869,456 A 9/1989 Jacobs
4,917,581 A 4/1990 Richardson
D308,247 S 5/1990 Adam
4,930,632 A 6/1990 Eckert
D309,571 S 7/1990 Lehman
5,076,534 A 12/1991 Adam
5,147,039 A * 9/1992 Sechler ..... B65D 19/004 108/53.1
5,224,508 A 7/1993 Bates, Jr.
5,230,601 A 7/1993 Apps et al.
5,249,699 A 10/1993 Williams
5,307,931 A * 5/1994 Gillispie ..... B65D 81/262 108/56.3
D353,665 S 12/1994 Jennings
5,392,944 A * 2/1995 Jennings ..... F24F 5/0035 220/571
5,429,236 A 7/1995 Evans
D368,409 S 4/1996 Schwartz
5,566,848 A * 10/1996 Rude ..... B21D 5/02 220/1.5
5,615,608 A * 4/1997 Shaw ..... B65D 19/0018 108/55.3
5,791,156 A 8/1998 Strautman et al.
D399,095 S 10/1998 Schmidt
5,848,536 A 12/1998 Dodge et al.
5,881,566 A 3/1999 Shacklock et al.
5,961,093 A 10/1999 Jones
5,966,958 A 10/1999 Maynard
5,966,959 A * 10/1999 Stewart ..... F24F 13/222 62/285
6,044,592 A 4/2000 Strieter
6,065,531 A 5/2000 Schneider et al.
D426,110 S 6/2000 Schmidt
6,112,536 A 9/2000 Hansen
D431,958 S 10/2000 Harris
6,125,647 A 10/2000 Martinez
6,286,328 B1 9/2001 Kawahara
6,360,911 B1 3/2002 Arnold
6,382,108 B1 * 5/2002 Stanek ..... B65D 19/0038 108/55.1
6,487,867 B1 12/2002 Herren
6,718,788 B1 * 4/2004 Shuck ..... B21D 51/18 220/571
6,745,704 B2 * 6/2004 Carter ..... B65D 90/24 108/55.1
6,766,615 B2 7/2004 Smead
6,797,894 B2 9/2004 Montagnino et al.
6,868,689 B1 3/2005 McNeil et al.
6,895,770 B1 5/2005 Kaminski
6,978,909 B2 12/2005 Geotzinger et al.
D590,123 S 4/2009 Hermans
D590,124 S 4/2009 Hermans
D590,572 S 4/2009 Hermans
D590,573 S 4/2009 Hermans
D600,874 S 9/2009 Hermans
D600,875 S 9/2009 Hermans
D608,917 S 1/2010 Ward et al.
2002/0000093 A1 1/2002 Lea
2008/0029684 A1 2/2008 Rowland
2010/0207004 A1 8/2010 Hermans et al.

FOREIGN PATENT DOCUMENTS

KR 20040020748 A * 3/2004
KR 200402748 Y1 12/2005
KR 1020040020748 9/2009
WO 00/39512 A1 7/2000
WO 03/064239 A1 8/2003
WO 2007/068036 A1 6/2007

OTHER PUBLICATIONS

Final Office Action for U.S. Appl. No. 11/833,298 dated Jun. 24, 2010.
Advisory Action for U.S. Appl. No. 11/833,298 dated Aug. 26, 2010.

* cited by examiner

DRAIN PAN WITH INTEGRATED RISER

CROSS REFERENCE TO RELATED APPLICATIONS

This application is a continuation of application Ser. No. 14/715,734, filed May 19, 2015, now U.S. Pat. No. 9,557,094, which is a continuation of application Ser. No. 11/320,992, filed Dec. 29, 2005, now U.S. Pat. No. 9,074,812, which claims the benefit of provisional application Ser. No. 60/640,332, filed Dec. 30, 2004, which are incorporated herein by reference.

TECHNICAL FIELD

The present invention relates generally to the field of drain pans and more particularly relates to a drain pan with an integrated riser.

BACKGROUND OF THE INVENTION

Air handling units, such as air conditioners, create condensation during operation. For instance, typical air conditioning units include a compressor and an evaporator including evaporator coils. The expansion process in the evaporator cools the evaporator coils. Air is cooled by being passed over the evaporator coils.

As the air passes over the evaporator coils, water may condense on the coils and drip from the coils. A primary drip pan and drain are installed under the evaporator coils to collect and drain the condensate. As a precautionary matter, a secondary drain pan is often installed beneath the air handling unit to secure any excess drainage not caught by the primary drip pan and drain.

Typically, a secondary drain pan is made of plastic or metal and is rectangularly shaped. The drain pans being used currently have a base and a lip for holding the condensate. Bricks, cinder blocks, wood, or other structures are often placed in the drain pan for supporting the air handling unit above the base of the drain pan by the installer of the air handling unit. The supports or risers are often found at the work site and are not precise in dimension. Therefore, installers of air handling units waste time and effort locating support structures to place in the drain pan and positioning those structures to support adequately the air handling unit.

Thus, there is a need in the art for a secondary drain pan that includes an integrated riser for supporting the air handling unit.

SUMMARY OF THE INVENTION

In one aspect of the application, a drain pan for an air handling unit includes a base, a lip attached to the base, wherein the lip extends substantially vertically from the base; and a riser affixed to the base, wherein the riser extends substantially vertically from the base to support the air handling unit. In one embodiment, the riser is preformed with the base to form a unibody drain pan.

In another embodiment, the riser includes a number of legs. The plurality of legs may be in a substiantially X shaped configuration. In other embodiments, the legs of the riser are in substantially rectangular or triangular configurations. In yet another embodiment, the drain pan may include a plurality of risers. The risers may be oriented in a substantially parallel position.

In another embodiment, the riser may be a substantially pyramidal shape or a substantially rectangular shape. In yet another embodiment, the riser may include a plurality of ribs to add support to the riser. In still yet another embodiment, the riser may be substantially hollow. A plurality of risers may be stacked using the substantially hollow space in the riser. In another embodiment, the lip may be attached to edges of the base.

In another embodiment, the drain pan is made of plastic or metal. In yet another embodiment, the drain pan may include a drainage pipe that allows fluid to flow out of the drain pan. The drainage pipe may interface the base of the drain pan through the lip.

In another aspect of the application, a method is provided for storing a plurality of drain pans. The method includes providing a first drain pan that has a base and a riser affixed to the base, wherein the riser extends substantially vertically from the base to support the air handling unit and has a substantially hollow space. The method further includes providing a second drain pan that has a base and a riser affixed to the base, wherein the riser extends substantially vertically from the base to support the air handling unit and is substantially hollow, and stacking the first drain pan on the second drain pan such that the riser of the second drain pan fits into the hollow space of the first drain pan.

DETAILED DESCRIPTION

The present application now will be described more fully hereinafter with reference to the accompanying drawings, in which several embodiments of the application are shown. This application may, however, be embodied in many different forms and should not be construed as limited to the embodiments set forth herein; rather, these embodiments are provided so that this disclosure will be thorough and will fully convey the scope of the application to those skilled in the art. Like numbers refer to like elements throughout.

Figure 1:
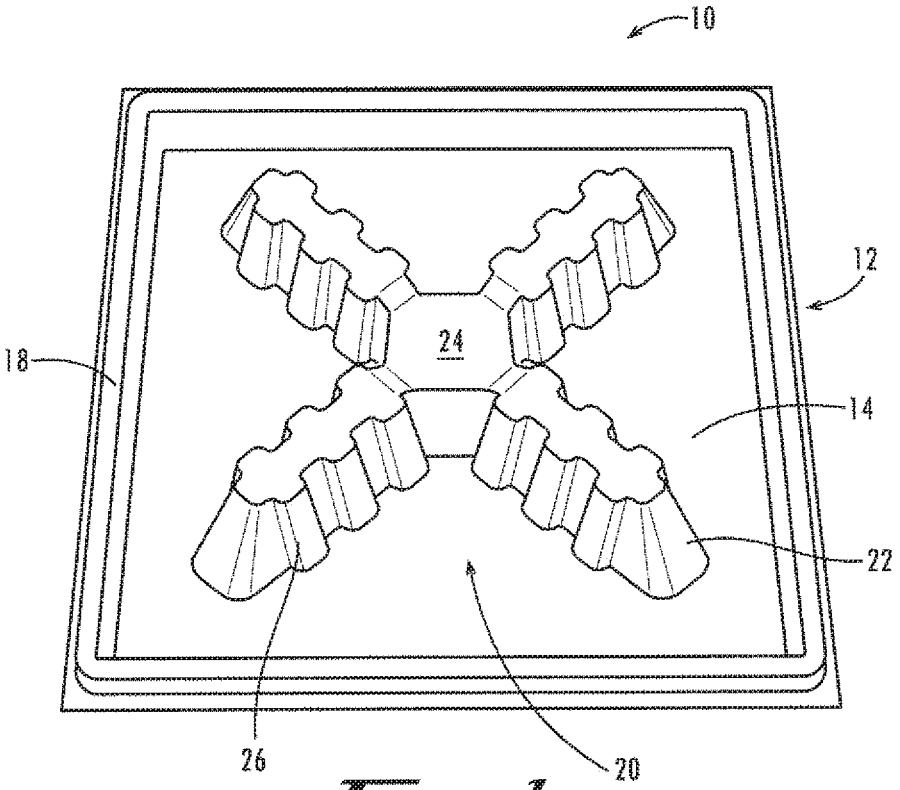
FIG. 1 is a perspective view of a drain pan with integrated riser according to an embodiment of the application.
Figure 2:
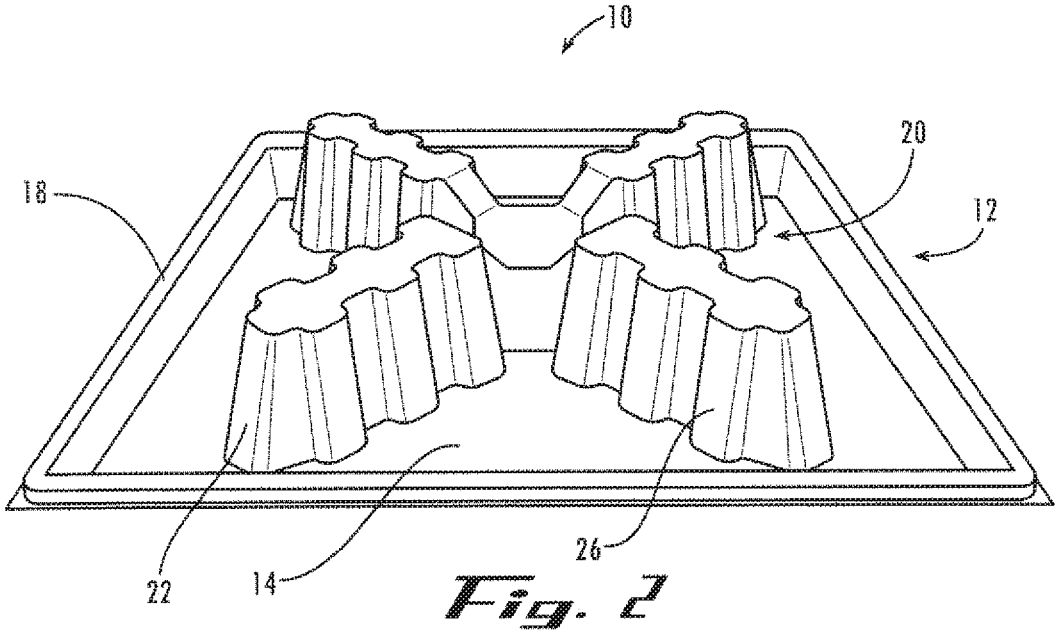
FIG. 2 is a perspective view of a drain pan with integrated riser according to an embodiment of the application.

FIGS. 1 and 2 illustrate an embodiment of the drain pan 10. The drain pan 10 includes a base 12, a top surface 14 of the base, and a bottom surface 16 of the base. The base may be any shape adequate for use with an air handling unit. It will be appreciated that the drain base may be rectangular, square, circular, polygonal, or any other shape.

The drain pan 10 may be made of any material with suitable weight and strength requirements including but not limited to plastic, metal, or ceramics. The drain pan 10 also should be made of a material suitable for use in high heat environments. For example, the drain pan 10 may be used in temperatures in excess of 140° F. in uses such as an attic. The metal may include steel, aluminum, or any other suitable metal. In an exemplary embodiment, the drain pan 10 is made of plastic with a thickness of approximately one quarter of an inch. One of ordinary skill in the art will appreciate that the drain pan 10 is not limited to plastic and the thickness is not limited to one quarter of an inch.

Furthermore, the drain pan 10 may be any size suitable for use under an air handling unit. Typical drain pans have dimensions in the range of approximately 14×48 inches to 38×62 inches. One of ordinary skill in the art will appreciate that the drain pan 10 is not limited to these dimensional ranges and may be any size necessary to accommodate any air handling unit. In another embodiment, the drain pan 10 may be located beneath any other device or structure attached to or positioned under the air handler such as a humidifier, sheet metal, plenum or any other device or structure.

The drain pan 10 further includes a lip 18 extending substantially vertically from the top surface 14 of the base. In an exemplary embodiment, the lip 18 extends from the edges of the top surface 14 of the base. It will be appreciated by one of ordinary skill in the art that the lip 18 may extend from any portion of the base and is not limited to the edges of the base. In an exemplary embodiment, the lip 18 extends approximately two inches from the top surface 14 of the base. Any lip tall enough to hold liquid drainage without spillage is contemplated herein. It will also be appreciated by one of ordinary skill in the art that the lip 18 does not have to intersect the top surface 14 of the base at a right angle. For example, the lip may be angled, have an angled intermediate lip, or include a beveled portion that intersects the top surface 14 of the base.

A riser 20 extends from the top surface 14 of the base. The riser 20 extends substantially vertically from the top surface 14 of the base 12 such that a top of the riser 20 is positioned vertically higher than a top of the lip 18. In an exemplary embodiment, the riser 20 extends approximately 3.75 inches from the top surface 14 of the base. One of ordinary skill in the art will appreciate that the riser 20 may be any height that extends above the top of the lip 18.

The riser 20 may be positioned at any location on the top surface 14 of the base. In an exemplary embodiment, the riser 20 is positioned in substantially the center of the top surface 14 of the base. It will be appreciated by one of ordinary skill in the art that the position of the riser is not limited to the center of the base but may be off-center including on the periphery of the top surface of the base, the corners of the base, or any other suitable location.

The drain pan 10 also may include at least two risers 20. The risers 20 may be positioned in any configuration adequate for supporting an air handling unit. In one embodiment, the drain pan 10 includes two risers 20 each positioned on opposite sides of the top surface 14 of the base. In another embodiment, the drain pan 10 includes four risers 20 each positioned in a corner of the top surface 14 of the base. One of ordinary skill in the art will appreciate that any number of risers is contemplated herein and that the risers may be positioned in any configuration on the top surface of the base.

Figure 3A:
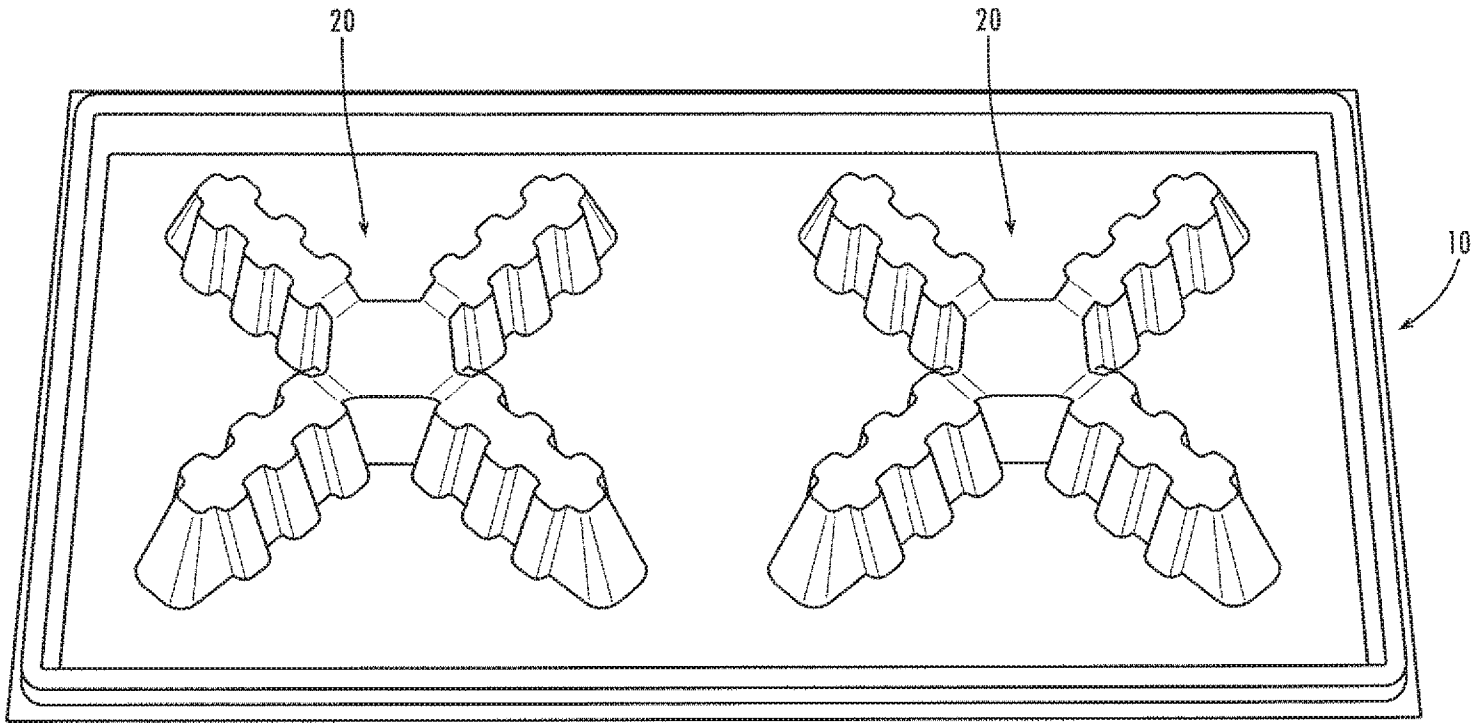
FIG. 3*a* is a perspective view of a drain pan with a plurality of integrated risers according to an embodiment of the application.

The riser 20 may be of any shape that is adequate for supporting an air handling unit. In an exemplary embodiment, the riser 20 includes legs 22 which create a substantially "X" configuration. In another aspect of the embodiment, each of the legs 22 of the "X" configuration of the riser 20 are shaped substantially pyramidal. It will be appreciated by one of ordinary skill in the art that the legs of the riser may be any shape including rectangular, triangular, conical, or any other shape. Further, the riser 20 may include other support structures to assist in the supporting of the air handling unit. In an exemplary embodiment, a substantially square support structure 24 resides between the legs of the riser for added support. In an exemplary embodiment illustrated in FIG. 3*a*, the drain pan 10 includes two sets of risers configured in a substantially "X" shaped configuration positioned on opposite ends of the top surface 14 of the base.

Figure 3B:
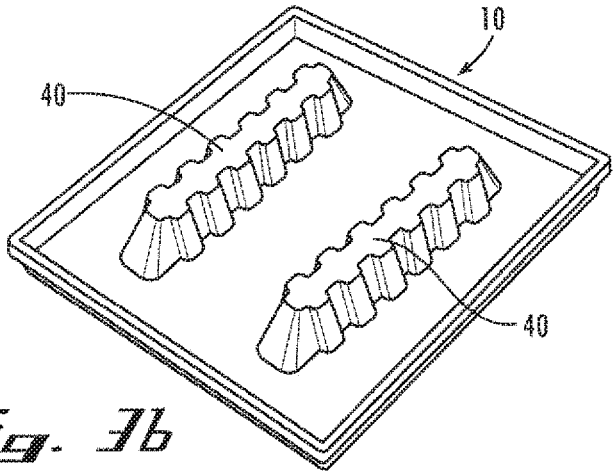
FIG. 3*b* is a perspective view of a drain pan with a plurality of integrated risers according to an embodiment of the application.
Figure 4:
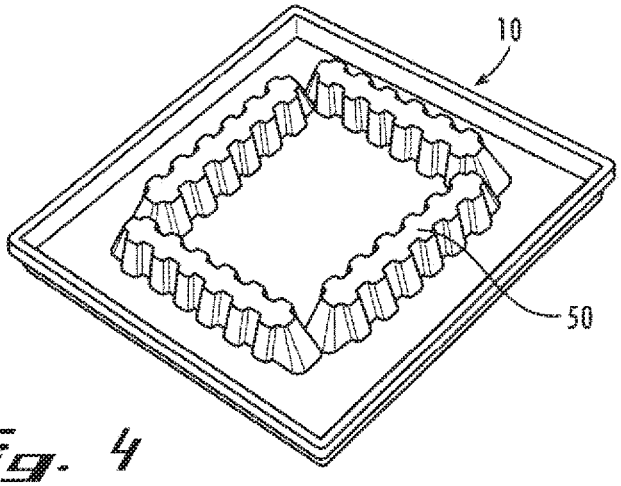
FIG. 4 is a perspective view of a drain pan with integrated riser in a rectangular configuration according to an embodiment of the application.
Figure 5:
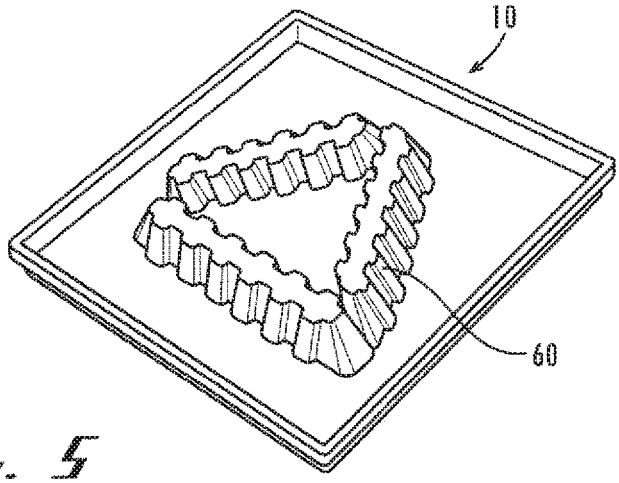
FIG. 5 is a perspective view of a drain pan with integrated riser in a triangular configuration according to an embodiment of the application.

The riser 20 is not limited to the "X" configuration. One of ordinary skill in the art will appreciate that the legs of the riser 20 may be positioned in any configuration including substantially rectangular, square, circular, oval, pyramidal or any other configuration that provides sufficient support to air handling units. In an exemplary embodiment illustrated in FIG. 3*b*, the drain pan 10 includes two substantially rectangular shaped risers 40 positioned on opposite sides of the top surface 14 of the base. In another exemplary embodiment shown in FIG. 4, the drain pan 10 includes a riser 50 positioned in a substantially rectangular position. In yet another exemplary embodiment shown in FIG. 5, the drain pan 10 includes a riser 60 positioned in a substantially triangular position.

The riser 20 may be substantially hollow or solid. The hollow riser provides a lighter drain pain than would a solid riser. In one embodiment, the legs 22 of the riser 20 further include ribs 26 for added support to the riser. It is contemplated that the ribs 26 are not necessary if the riser 20 can provide sufficient support without the ribs 26.

The riser 20 is affixed to the base 12 of the drain pan 10. In an exemplary embodiment, the riser 20 is preformed with the base 12 of the drain pain 10 as a unibody structure. The formation of the unibody drain pan may be manufactured through the use of molds or any other manufacturing technique. In another embodiment, the riser 20 and the base 12 are formed separately and the riser 20 is then affixed to the top surface 14 of the base of the drain pain.

Figure 6:
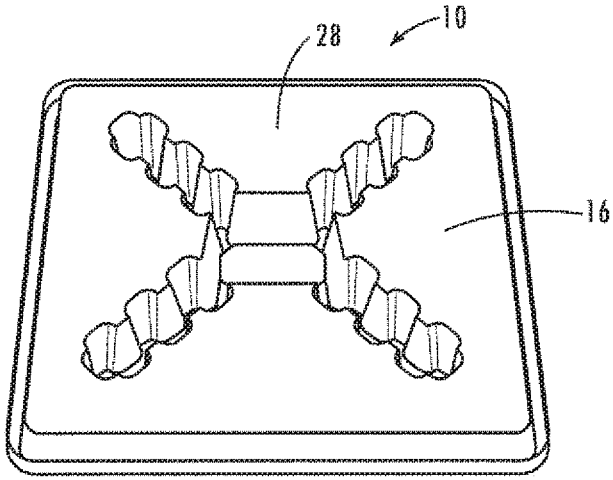
FIG. 6 is a perspective view of the bottom surface of a drain pan with a hollow riser.
Figure 7:
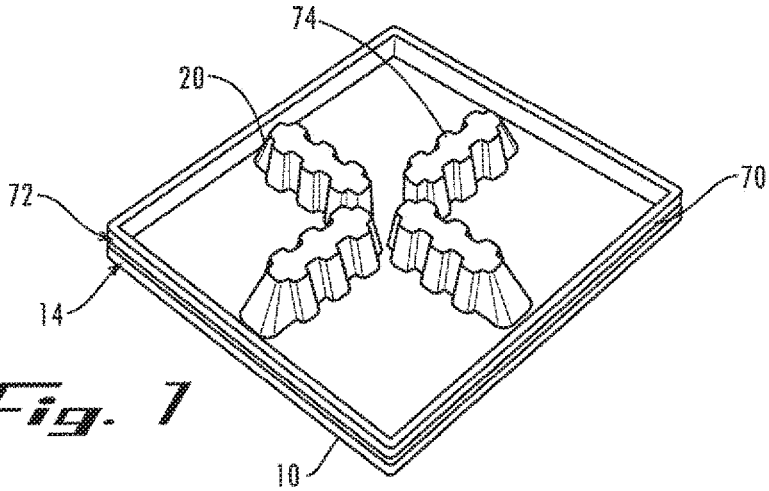
FIG. 7 is a perspective view of a first drain pan with integrated riser stacked with a second drain pan with integrated riser according to an embodiment of the application.

FIG. 6 illustrates an embodiment of the drain pan 10 with the hollow riser 20. The bottom surface 16 of the base provides openings 28 aligned with the riser 20. As shown in FIG. 7, the openings 28 allow a plurality of drain pans of the same configuration to be stacked together. The plurality of drain pans may be stacked by interfacing the top surface 14 of the base and riser 20 of a first drain pan 10 with a bottom surface 72 of a base and a riser 74 of a second drain pan 70. The stackable utility of the drain pan 10 allows a plurality of drain pans to be stacked together to aid in shipping, retail, or distribution of the drain pans.

Figure 8:
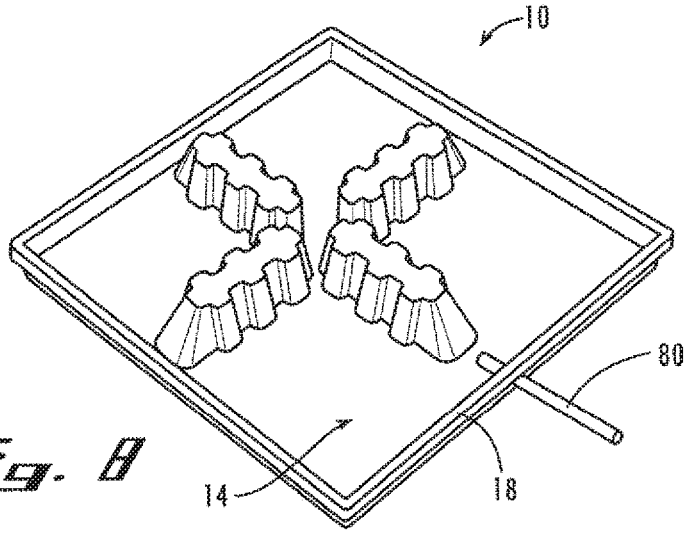
FIG. 8 is a perspective view of a drain pan with integrated riser with a drainage pipe according to an embodiment of the application.

The drain pan 10 may be used as a secondary drain pan for air handling units. The drain pan 10 may be placed beneath the air handling unit to support the air handling unit and to receive any drainage not accumulated in the primary drain pan. The riser 20 on the drain pan 10 may be used to support the air handling unit such that the air handling unit rests on the riser. One of ordinary skill in the art will appreciate that adhesive or cushion may be placed on top of the riser so that the adhesive or cushion resides between the riser and the air handling unit to further secure the air handling unit on the riser. In an exemplary embodiment, mastic adhesive is affixed to the top of the riser; however, any adhesive is contemplated herein. The drainage not accumulated in the primary drain pan would be secured in the base of the drain pan 10. The liquid drainage may be secured on the base 12 of the drain pan 10 by the lip 18. In an exemplary embodiment illustrated in FIG. 8, the drain pan 10 may include a drainage pipe 80. The drainage pipe 80 may interface the top surface 14 of the base or a location on the lip 18. The drainage pipe 80 may intersect the lip 18 to access the top surface 14 of the base. The drainage pipe may be used to remove excessive liquid drainage from the drain pan.

In another embodiment, the drain pan 10 may be used to collect drainage from an air handling unit but not support the air handling unit. For example, the drain pan 10 may be hung beneath the air handling unit in a non-load bearing capacity.

It should be apparent that the foregoing relates only to exemplary embodiments of the present application and that numerous changes and modifications may be made herein without departing from the spirit and scope of the application as defined herein.

I claim:

1. A load-bearing drain pan configured to be placed under an air handling unit to secure and drain condensate from the air handling unit and to support the air handling unit, the load-bearing drain pan comprising:

(a) a base;

(b) a lip extending upward from a perimeter of the base;

(c) one or more risers extending upward from the base, (i) wherein the base, the lip, and the one or more risers comprise a unitary molded structure, (ii) wherein the one or more risers comprise side walls and an upper support surface configured to support the air handling unit thereon, and (iii) wherein the side walls extend upward from the base and an outer surface of the side walls extends laterally to form the upper support surface; and (d) a support structure extending upward from the base and disposed between and interconnecting the one or more risers.

2. The load-bearing drain pan of claim 1 wherein the upper support surface is further configured to support the air handling unit indirectly thereon.

3. The load-bearing drain pan of claim 1 further comprising at least one cushion between the air handling unit and the upper support surface when the air handling unit is placed on the load-bearing drain pan.

4. The load-bearing drain pan of claim 1 wherein the one or more risers are enclosed from all sides, limiting air or water from passing through the one or more risers so that drainage descends to the base.

5. The load-bearing drain pan of claim 1 wherein the one or more risers and the support structure are at least partially hollow such that the one or more risers and support structure of another similarly shaped load-bearing drain pan are nestably stackable within the one or more risers and the support structure.

6. The load-bearing drain pan of claim 1 further comprising at least one rib disposed along the side walls of the one or more risers.

7. The load-bearing drain pan of claim 1 wherein a distance between the one or more risers varies along a length of the one or more risers.

8. The load-bearing drain pan of claim 1 wherein the upper support surface of the one or more risers is positioned above the lip.

9. The load-bearing drain pan of claim 1 further comprising a drainage opening through the lip.

10. An apparatus structured to support an air handling unit and to be positioned to collect condensate of the air handling unit, the apparatus comprising:

a load-bearing, molded pan having:

(a) an interior surface formed by at least:

(i) a bottom surface;

(ii) an edge wall that extends upward from a perimeter surrounding the bottom surface to a rim;

(iii) a plurality of interior walls, each extending upward from the bottom surface; and (iv) a plurality of upper surfaces above the bottom surface, wherein each of the plurality of upper surfaces extends between two of the interior walls; and (v) a surface of a connecting structure above the bottom surface and extending between a first of the interior walls and a second of the interior walls, wherein the first of the interior walls is connected to a first of the plurality of upper surfaces and the second of the interior walls is connected to a second of the plurality of upper surfaces; and (b) an exterior surface that meets the interior surface at the rim;

wherein the volume above the interior surface and below the rim is contiguous.

11. The apparatus of claim 10 wherein the load-bearing, molded pan is structured to support the air handling unit indirectly thereon.

12. The apparatus of claim 11 further comprising a cushion, whereby the cushion is between the load-bearing, molded pan and the air handling unit when the air handing unit is supported by the load-bearing, molded pan.

13. The apparatus of claim 10 wherein each of the plurality of interior walls extend farther from the bottom surface than the connecting structure extends from the bottom surface, whereby the plurality of upper surfaces are positioned above the connecting structure.

14. The apparatus of claim 10 wherein the plurality of interior walls, the plurality of upper surfaces, and the surface of the connecting surface together form a continuous surface structured to limit the passage of fluid therethrough, whereby condensate from the air handling unit supported by the load-bearing, molded pan descends to the bottom surface.

15. The apparatus of claim 10 wherein each of the plurality of upper surfaces is structured to limit the passage of fluid through the plurality of upper surfaces, whereby condensate from the air handling unit, when supported by the load-bearing, molded pan, descends to the bottom surface.

16. The apparatus of claim 10 wherein the exterior surface has a shape that substantially corresponds to a shape of the interior surface, whereby the load-bearing, molded pan is stackable with another load-bearing, molded pan having the same shape, (i) with the exterior surface of the load-bearing, molded pan substantially adjacent to the interior surface of the other load-bearing, molded pan when the load-bearing, molded pan is stacked above the other load-bearing, molded pan, and (ii) with the interior surface of the load-bearing, molded pan substantially adjacent to the exterior surface of the other load-bearing, molded pan when the load-bearing, molded pan is stacked below the other load-bearing, molded pan.

17. The apparatus of claim 10 wherein each of the plurality of interior walls extends upward from the bottom surface at a non-orthogonal angle.

18. The apparatus of claim 10 wherein each of the plurality of interior walls extends upward from the bottom surface along a serpentine path along the bottom surface.

19. The apparatus of claim 10 wherein a distance between the first of the plurality of interior walls and the second of the plurality of interior walls varies along a length of the first of the plurality of upper surfaces.

20. The apparatus of claim 10 wherein at least some of the plurality of interior walls extend farther from the bottom surface than the edge wall, whereby the plurality of upper surfaces is positioned above the rim.

21. The apparatus of claim 10 wherein, for at least a first of the plurality of upper surfaces, a cross-section, orthogonal to the first of the plurality of upper surfaces and orthogonal to two of the plurality of interior walls between which the first of the plurality of upper surfaces extends, together with a line connecting bottoms of the two of the plurality of interior walls, forms a trapezoid.

22. The apparatus of claim 10 wherein the interior surface further comprises a hole, whereby the hole permits fluid collected by the load-bearing, molded pan to be drained from the load-bearing, molded pan.

* * * * *